US005285033A

United States Patent [19]

Ipcinski

[11] Patent Number: 5,285,033

[45] Date of Patent: Feb. 8, 1994

[54] TILT ACTION SWITCH

[75] Inventor: Ralph Ipcinski, Hollis, N.H.

[73] Assignee: C&K Components Inc., Newton, N.H.

[21] Appl. No.: 959,490

[22] Filed: Oct. 9, 1992

Related U.S. Application Data

[63] Continuation of Ser. No. 740,074, Aug. 5, 1991, abandoned.

[51] Int. Cl.[5] ..... H01H 35/02

[52] U.S. Cl. ..... 200/62.52

[58] Field of Search ..... 200/61.52, 61.45 R, 200/61.45 M, DIG. 29

[56] References Cited

U.S. PATENT DOCUMENTS

| | | | |
|---|---|---|---|
| 1,915,267 | 6/1933 | Bigelow | 200/DIG. 29 X |
| 2,365,262 | 12/1944 | Gair | 200/61.52 |
| 4,297,683 | 10/1981 | Roberts | 200/62.52 X |
| 4,591,676 | 5/1986 | Jackman et al. | 200/61.45 M |
| 4,628,160 | 12/1986 | Canevari | 200/61.45 R |
| 4,688,025 | 8/1987 | Frank | 200/61.45 R X |
| 4,874,166 | 10/1989 | Kuna | 273/1 GC |
| 5,025,246 | 6/1991 | Schenkel | 200/61.45 R X |
| 5,039,843 | 8/1991 | Muller | 200/61.45 R X |

*Primary Examiner*—J. R. Scott

[57] ABSTRACT

The invention disclosed herein is directed to a tilt action switch using a ball bearing as the movable contact in a body portion. The body portion includes upper and lower segments formed of conductive material. The upper and lower segments are attached together to provide a cavity within which the ball bearing movable contact is positioned. The upper and lower segments each include normally extending support portions with inner surfaces. The inner surface of the upper and lower segments are part with an insulating spacer.

1 Claim, 2 Drawing Sheets

TILT ACTION SWITCH

This is a continuation of co-pending application Ser. No. 07/740,074 filed on Aug. 5, 1991, abandoned.

BACKGROUND OF THE INVENTION

Field of the Invention

This invention relates to electric switches and more specifically to a tilt action switch utilizing a ball bearing as a movable contact.

SUMMARY OF THE INVENTION

The invention disclosed herein is directed at a tilt action switch having an upper body portion and a lower body portion. The upper body portion and the lower body portion are attached together to provide a cavity within which a ball bearing movable contact is positioned. The upper and lower body portions are spaced from each other and each has its facing surface partially covered by an insulating spacer.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
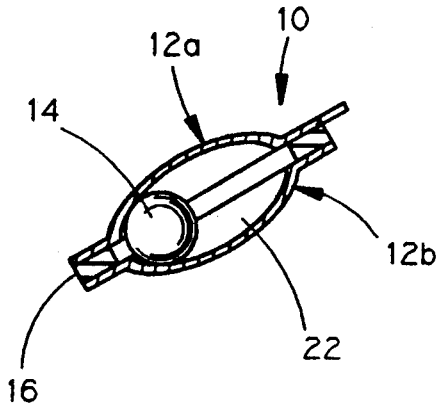
FIG. 1 is a section of the tilt action switch, actuated, according to the present invention.
Figure 2:
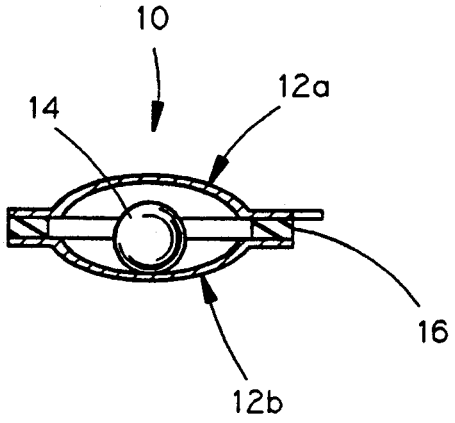
FIG. 2 is a section of the tilt action switch, not actuated, according to the present invention.
Figure 3:
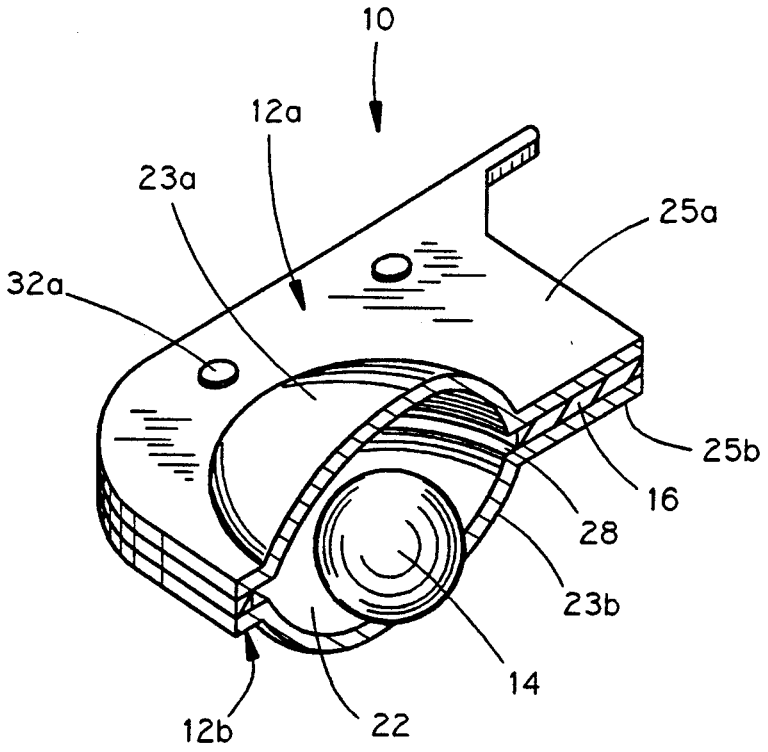
FIG. 3 is a section of a perspective view of the tilt action switch, not actuated, according to the present invention.

There is shown in the drawings a tilt action switch 10 comprising an upper body portion 12*a* and a lower body portion 12*b* which may be of varying configuration such as spoon, spherical or conical, for example, a movable contact or ball bearing 14 and a spacer 16. Each of the body portions 12*a*, 12*b* is formed of a non ferrous metal, such as brass. The movable contact or ball bearing 14 is formed of a non ferrous metal, such as brass which is externally silver plated. The spacer 16 is formed of a non conductive plastic. The operation of the switch 10 depends on the shape of the upper and lower body portions 12*a*, 12*b*, the diameter of the movable contact 14 and the width of the spacer 16. The upper and lower body portions 12*a*, 12*b* are, in this embodiment, partially hemispherical in configuration providing arced portions 23*a*, 23*b* respectively, which are in opposed relation to form a spherical cavity 22. A support portion 25*a* extends from the edges of the arced portion 23*a* in integral, right angle relation thereto to the edges of the body portion 12*a* and a support portion 25*b* extends from the edges of the arced portion 23*b* in integral, right angle relation thereto to the edges of the body portion 12*a*.

The spacer 16 is planar and fits between the upper body portion 12*a* and the lower body portion 12*b*. The spacer 16 also includes a centrally positioned through aperture 26 which has a diameter slightly greater than either of the arced portions 23*a*, 23*b* thereby providing a circumferential lip 28 on each of the arced portions 23*a*, 23*b* in relation to the aperture 26 of the spacer 16. Four studs 30 extend from each planar surface of the spacer 16 which are adapted to be passed through four holes 32*a*, 32*b* formed in the support portions, 25*a*, 25*b* respectively. The inner surfaces of the arced portions 23*a*, 23*b* are silver plated.

The switch 10 is assembled by positioning the spacer 16 on either the upper body portion 12*a*, or the lower body portion 12*b*. The studs 30 extend through the holes of, for example, the body portion 12*b*. The movable contact or ball bearing 14 is positioned in the arced portion 23*b*. The upper body portion 12*a* is positioned on the spacer 16 with the second set of studs 30 extending through the holes of the upper body portions 12*a* trapping the ball bearing 14 in the cavity 22. The planar portions of the spacer 16, and the upper and lower body portion support portions 25*a*, 25*b* are in parallel relation with each other.

Figure 4:
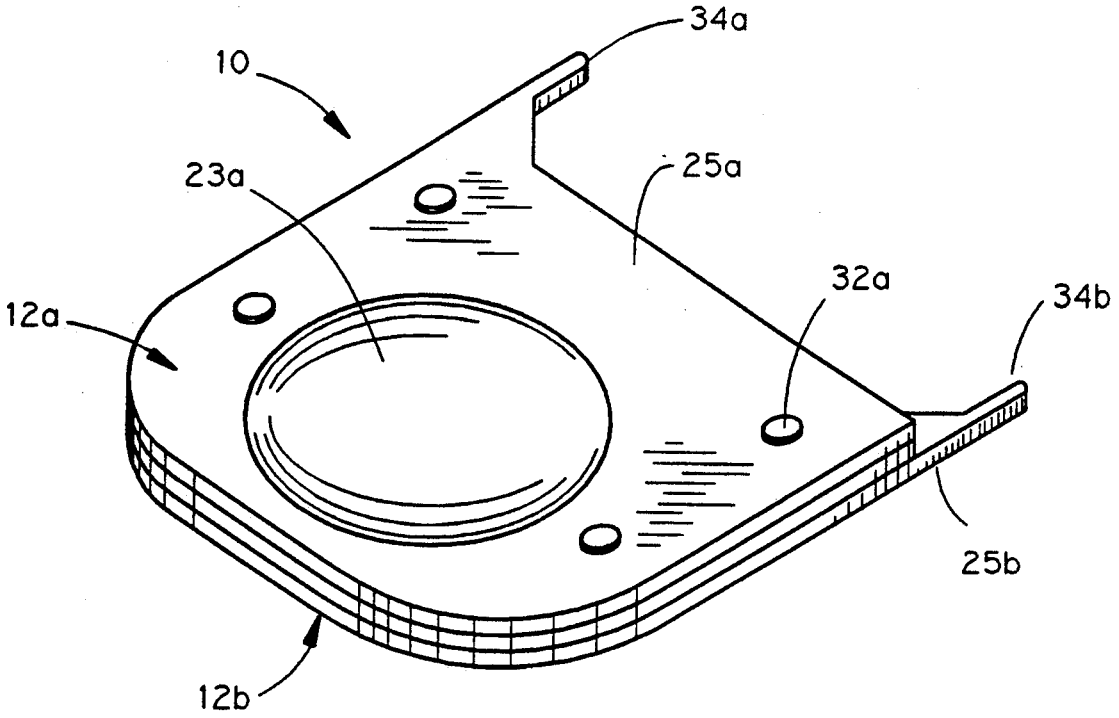
FIG. 4 is a perspective view of the tilt action switch shown in FIG. 3.
Figure 5:
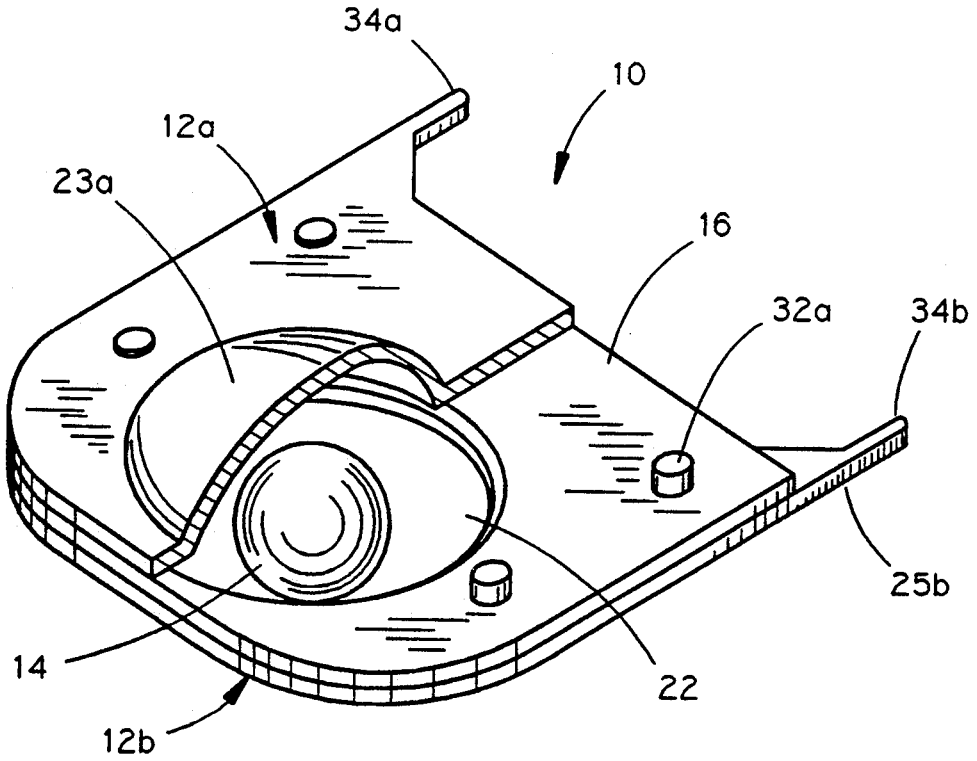
FIG. 5 is a perspective view of the tilt action switch shown in FIG. 3 with the upper body portion sectioned.

In operation, if the planar portions of the spacer 16, and the upper and lower body portions 12*a*, 12*b* are maintained on a horizontal plane the ball bearing 14 will rest in the center of the arced portion 23*b*, for example, and no circuit will be completed. If the switch should be moved to a slightly vertical plane, the ball bearing 14, which has a diameter greater than the thickness of the spacer 16, will bridge the circumferential lips 28 of the arced portions 23*a*, 23*b* activating the circuit. Each of the upper and lower body portions 12*a*, 12*b* has a terminal extension 34*a*, 34*b* respectively as shown in FIGS. 4 and 5 providing a means of electrically engaging a circuit. The terminal extensions 34*a*, 34*b* project outwardly from and are integral parts of the planar support portions 25*a*, 25*b*, of the upper and lower body portion 12*a*, 12*b*.

The tilt action switch 10 can be mounted in a horizontal or vertical position. The switch 10 may be utilized on any equipment that it is desirable to sense specific movement, picking the equipment up, for example. The switch 10 is capable of detecting motion or to a lesser extent vibration. Obviously the switch 10 can be used as an element in a security system to protect products in a store. Each of the upper and lower body portions 12*a*, 12*b* is connected to a line of a circuit and when the movable contact (i.e. ball bearing 14) bridges the lips 28 of the upper any lower body portions 12*a*, 12*b* an electrical circuit may be completed.

What I claim is:

1. A tilt action switch having a ball bearing movable contact and a body portion, the body portion including an electrically conductive upper segment and an electrically conductive lower segment, the upper segment and lower segment each providing an arced portion, each of the arced portions having edges defining same, the upper segment having a first support portion extending from the edges of its arced portion in integral, right angle relation thereto and the lower segment having a second support portion extending from the edges of its arced portion in integral, right angle relation thereto, the upper segment and the lower segment being attached together with the arced portions in opposed relation to form a spherical cavity within which the ball bearing movable contact is positioned, the first support portion and second support portion including inner surfaces and the inner surfaces of the first and second support portions have a insulating spacer sandwiched therebetween, the upper and lower segments and each having an integral planar terminal extending outwardly from its segment.

* * * * *